US008002460B2

(12) United States Patent
Daout et al.

(10) Patent No.: US 8,002,460 B2
(45) Date of Patent: Aug. 23, 2011

(54) HAIRSPRING FOR A BALANCE WHEEL/HAIRSPRING RESONATOR

(75) Inventors: Jérôme Daout, Rolle (CH); Richard Bossart, Lausanne (CH)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 12/511,420

(22) Filed: Jul. 29, 2009

(65) Prior Publication Data

US 2010/0027382 A1 Feb. 4, 2010

(30) Foreign Application Priority Data

Jul. 29, 2008 (EP) ..... 08405188

(51) Int. Cl.
*G04B 17/04* (2006.01)

(52) U.S. Cl. ..... 368/175; 368/177; 368/178

(58) Field of Classification Search ..... 368/175–178, 368/168–174
See application file for complete search history.

(56) References Cited

U.S. PATENT DOCUMENTS

| | | | | |
|---|---|---|---|---|
| 209,642 | A | 11/1878 | Berlitz et al. | |
| 278,173 | A * | 5/1883 | Osgood | 368/171 |
| 811,346 | A * | 1/1906 | Weser | 368/175 |
| 1,440,363 | A * | 1/1923 | Andrade | 368/175 |
| 2,632,292 | A * | 3/1953 | Amend, Jr. | 368/164 |
| 3,553,956 | A * | 1/1971 | Schwartz | 368/158 |
| 3,934,403 | A * | 1/1976 | Tilse | 368/175 |
| 7,682,068 | B2 * | 3/2010 | Bourgeois | 368/169 |
| 2005/0068852 | A1 | 3/2005 | Hessler et al. | |
| 2005/0281137 | A1 | 12/2005 | Bourgeois et al. | |

FOREIGN PATENT DOCUMENTS

| | | | |
|---|---|---|---|
| CN | 1601402 | A1 | 3/2005 |
| CN | 1677283 | A * | 10/2005 |
| EP | 1422436 | A1 | 5/2004 |
| FR | 2447571 | A | 8/1980 |

OTHER PUBLICATIONS

European Search Report of EP 08405188, date of mailing Feb. 18, 2009.

* cited by examiner

*Primary Examiner* — Sean Kayes
(74) *Attorney, Agent, or Firm* — Westerman, Hattori, Daniels & Adrian, LLP

(57) ABSTRACT

Hairspring for a balance wheel/hairspring resonator, comprising n blades, where n≧2, which are fastened via at least one of their respective homologous ends and wound in spirals with an angular offset capable of neutralizing the lateral forces liable to be exerted on its central arbor when one of the ends of each blade is moved angularly around said central arbor relative to its other end.

16 Claims, 6 Drawing Sheets

HAIRSPRING FOR A BALANCE WHEEL/HAIRSPRING RESONATOR

BACKGROUND OF THE INVENTION

The present invention relates to a hairspring for a balance wheel/hairspring resonator.

DESCRIPTION OF THE PRIOR ART

It is known that the center of gravity of a flat hairspring moves during the oscillatory movement of the balance wheel. This is due to the fact that one of the ends of the hairspring is fixed, whereas the other end moves while still remaining at the same distance from the balance wheel arbor. This displacement of the center of gravity has an influence on the isochronism because it generates lateral forces on the pivots of the balance wheel arbor.

Abraham-Louis Breguet had the idea of providing the flat hairspring with one or two terminal curves enabling this defect to be remedied. Subsequently, a theoretical treatment of such a curve was published by M. Phillips.

Before the solution devised by Breguet and Phillips, T. Mudge had proposed the use of two hairsprings fastened to the same balance wheel and offset by 180°. Since the hairsprings work in synchronism, but in phase opposition, the variations in their respective centers of gravity are compensated for, but their axial offset creates, however, a slight torque in a plane containing the balance wheel arbor. This solution has been adopted in recent productions.

The problem with this solution lies in the fact that it is necessary to have two superposed hairsprings, increasing the height, two studs and two stud carriers that are offset by 180° about the balance wheel arbor, and two regulator pins, and each hairspring must be regulated in perfect synchronism with the other, leading to an extremely complex solution difficult to implement. In addition, it doubles the number of components.

This solution has been adopted in several publications, especially in U.S. Pat. No. 3,553,956, in FR 2 447 571 and in CN 1 677 283.

The object of the present invention is to benefit from the advantages of this solution while remedying, at least in part, the abovementioned drawbacks.

SUMMARY OF THE INVENTION

For this purpose, the subject of the present invention is a hairspring for a balance wheel/hairspring resonator, which hairspring comprises n blades, where $n \geqq 2$, fastened via at least one of their respective homologous ends are wound in spirals with an angular offset capable of neutralizing the lateral forces likely to be exerted on its central arbor when one of the ends of each blade is moved angularly about said central arbor relative to its other end.

BRIEF DESCRIPTION OF THE DRAWINGS

The appended drawings illustrate schematically, and by way of example, several embodiments of the hairspring forming the subject of the present invention.

DESCRIPTION OF THE PREFERRED EMBODIMENTS

Figure 1:
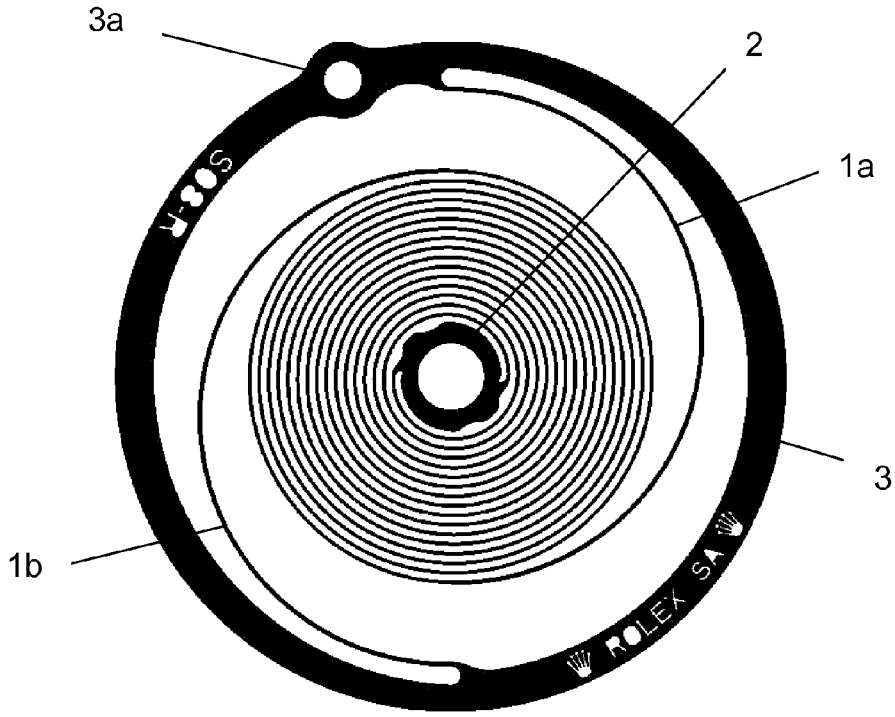
FIG. 1 is a plan view of a first embodiment.

The first embodiment of the hairspring forming the subject of the invention is illustrated in FIG. 1. This flat hairspring comprises two blades 1*a*, 1*b* wound in the same direction, but with an offset of $2\pi/2$, i.e. 180°. The respective internal ends of these blades 1*a*, 1*b* are fastened to a collet 2 and their external ends are fastened to a fastening ring 3. These external ends are also angularly offset by 180°. The fastening ring 3 to which the external ends of the blades 1*a*, 1*b* of the hairspring are fastened has an opening 3*a* for fastening it to the balance wheel bridge. This fastening ring 3 therefore replaces the conventional stud.

The two blades 1*a*, 1*b* of the hairspring must not touch each other as they contract and expand. The risk of so doing increases with the amplitude. Therefore, this can be reduced by limiting the amplitude. However, it may be also advantageous to increase the diameter of the hairspring.

Figure 3:
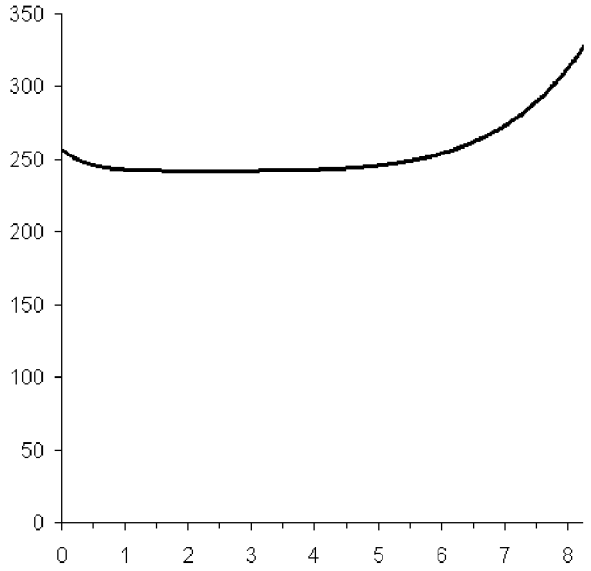
FIG. 3 is a graph showing the variation of the hairspring pitch plotted as a function of the number of turns from the center outwards in the case of the embodiment shown in FIG. 2.
Figure 4:
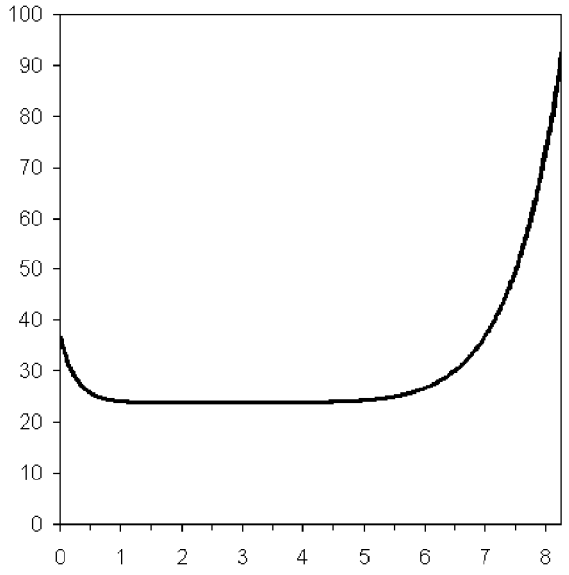
FIG. 4 is a graph showing the variation in the thickness along the blade plotted as a function of the number of turns from the center outwards in the case of the embodiment shown in FIG. 2.

Yet another solution is that which consists in varying the pitch of the turns and varying the thickness of the blades. This is shown by the embodiment in FIG. 2, and also the graphs of FIGS. 3 and 4 which illustrate the variation in the pitch of the turns in microns and the variation in the thickness of the blades in microns, respectively, as a function of the number of turns $N_t$ of the wound blades 1*a*, 1*b* of FIG. 2, starting from the center of the hairspring toward the outside, so as to prevent the turns of the blades 1*a*, 1*b* from touching each other during the alternating expansion and contraction of the hairspring. FIG. 3 plots one of the two blades 1*a*, 1*b* through the formula $r(\theta)=r_0+p(\theta)\times\theta/2\pi$, where r represents the distance from the arbor to the neutral fiber of the blade and $r(\theta=0)=r_0=600$ microns in the case of FIGS. 2 to 4 and $\theta=2\pi N_t$.

As a variant, the height of the hairspring blade could also be varied.

In the case of hairsprings made of single-crystal silicon, a material that can be used to produce the hairspring according to the invention, the temperature compensation of the hairspring is achieved by forming, on the surface of the hairspring blades, a layer of amorphous silicon oxide, the thermal coefficient of the Young's modulus of which is of opposite sign to that of single-crystal silicon, as described in EP 1 422 436. This amorphous silicon oxide layer makes it possible to compensate for the thermal coefficient of the Young's modulus whatever the crystallographic orientation of the silicon, namely (100), (111) or (110).

Figure 5:
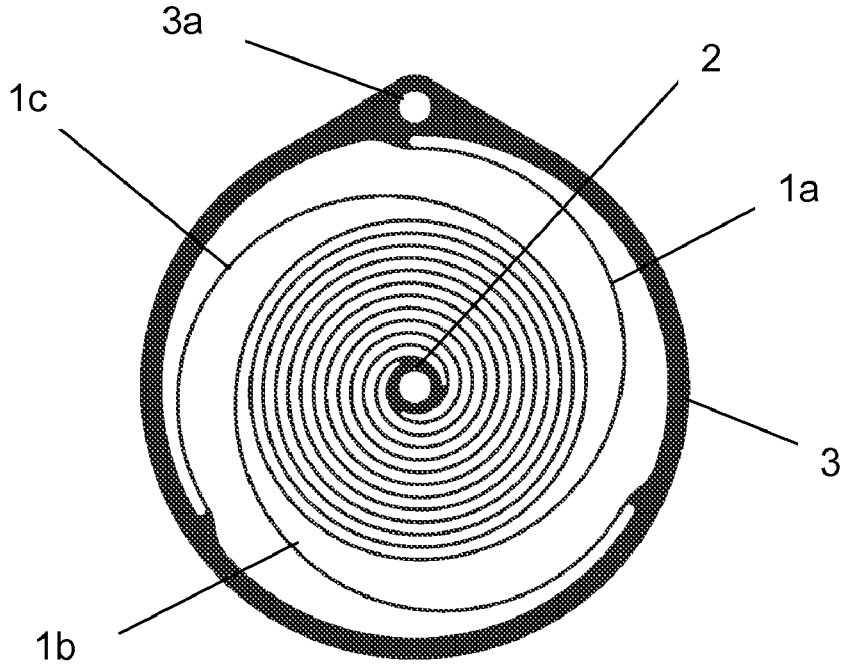
FIG. 5 is a plan view of a third embodiment.

The number of blades forming the hairspring is not limited to two. As a variant, various other solutions may be envisioned, such as that illustrated in FIG. 5, which is a variant of that of FIG. 1, but which has three blades 1*a*, 1*b* and 1*c* attached, on the one hand, to the collet 2 and, on the other hand, to the fastening ring 3. The internal and external ends of these blades are angularly offset with respect to one another by an angle of $2\pi/3$. This angular offset will advantageously be $2\pi/n$, where n corresponds to the number of blades.

Figure 2:
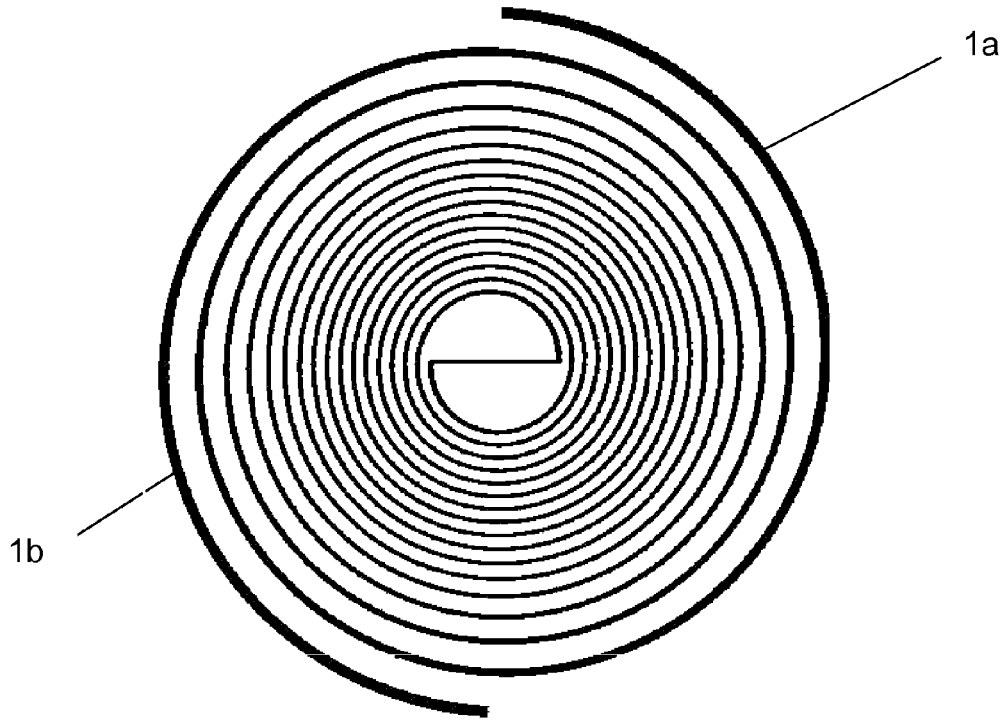
FIG. 2 is a plan view of a second embodiment.

Simulations carried out based on the hairsprings of FIGS. 1 and 2 have shown that it ought to be possible for the isochronism of a balance wheel/hairspring resonator fitted with a hairspring according to the present invention to be very substantially improved.

Figure 6:
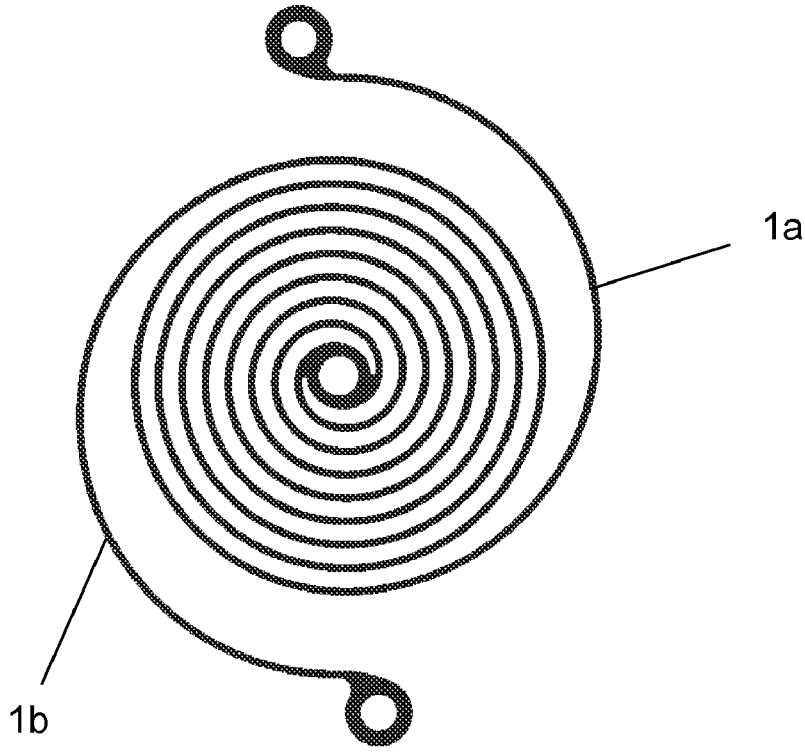
FIG. 6 is a plan view of a fourth embodiment.

In the embodiments described hitherto, the blades forming the hairspring are attached to one another via their two respective ends. The embodiment illustrated in FIG. 6 shows a hairspring formed from two blades 1*a*, 1*b* attached via only their internal ends to the collet 2. Their external ends are free, thereby making it possible to pretension the two blades, in one direction or another, so as in particular to adjust the isochronism.

Other variants using the same concept, namely a hairspring having several angularly offset coplanar blades attached via at least one of their respective homologous ends, can be envisioned.

Thus, it is possible to have a hairspring comprising four blades, namely two blades 1*a*, 1*b* placed between the collet 2 and an intermediate ring 4, to which their external ends are fastened, and two blades 1*c*, 1*d* placed between the intermediate ring and the fastening ring 3. To make the intermediate ring 4 as light as possible, its structure may be apertured so as to reduce its weight as far as possible.

Figure 7:
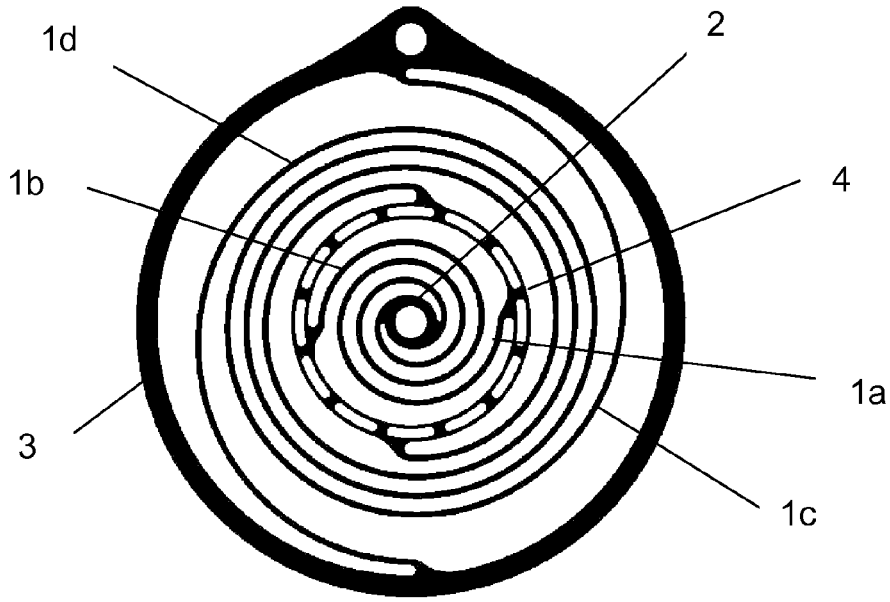
FIG. 7 is a plan view of a fifth embodiment.
Figure 8:
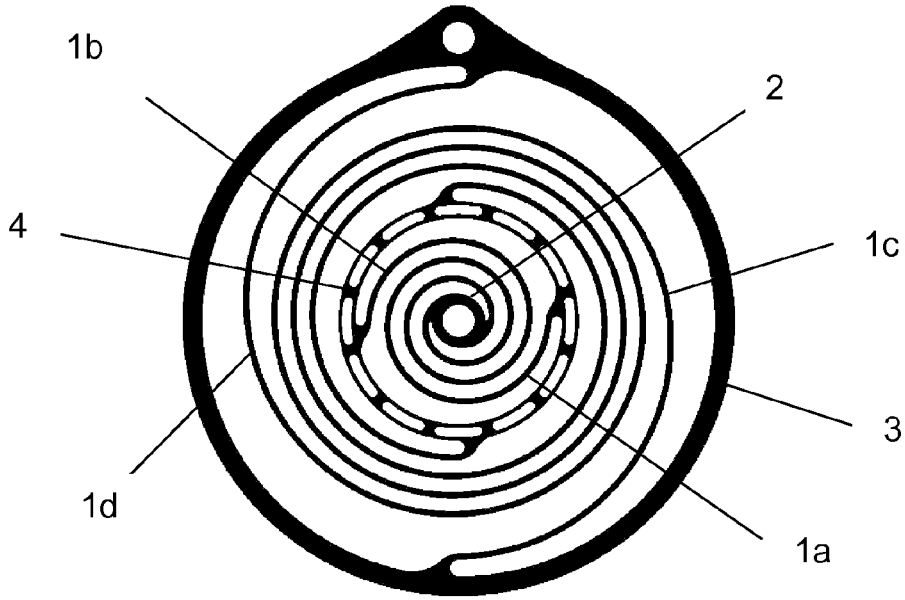
FIG. 8 is a plan view of a sixth embodiment.

The internal blades 1*a*, 1*b* and the external blades 1*c*, 1*d* may all be wound in the same direction, as illustrated in FIG. 7, or the internal blades 1*a*, 1*b* may be wound in the opposite direction to that of the external blades 1*c*, 1*d*, as illustrated in FIG. 8.

It is obvious that countless other combinations may be envisioned.

It is also obvious that the novel design of the hairspring according to the invention does not lend itself to being manufactured using the conventional processes for Nivarox/Parachrom hairsprings.

In the present case, a process very suitable for the manufacture of the hairspring according to the invention is in particular the one described in EP 1 422 436, already mentioned, which consists in cutting the hairspring, for example by plasma etching, from an {001} single-crystal silicon wafer. The hairspring is temperature-compensated by the formation of a layer of amorphous silicon oxide on the surface of the hairspring blades, for example by a heat treatment.

It would also be possible to use a quartz single crystal machined in the same way or by chemical machining. Other appropriate materials, adapted to the embodiments for producing a hairspring in a plane, can be used.

The use of photolithographic processes, such as the UV-LIGA (Lithographie, Galvanisierung und Abformung) process, could also be used to produce this type of hairspring according to the present invention made of a metal alloy.

The manufacturing process does not form part of the present invention. The nonlimiting examples of processes, listed above by way of example, are merely intended to demonstrate that the technical means for producing the novel type of hairspring according to the invention already exist and that a person skilled in the art has a raft of options for producing this hairspring.

Figure 9:
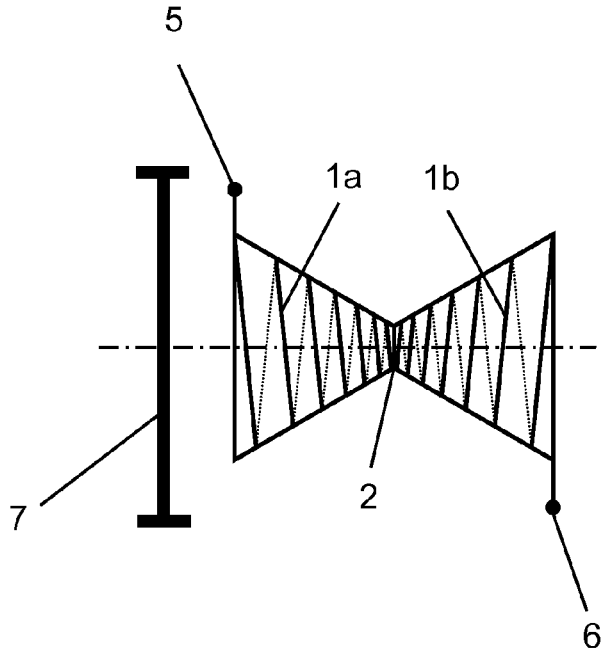
FIG. 9 is a side view of a seventh embodiment.

When the hairspring is referred to as being flat, this is the hairspring as obtained above. However, nothing precludes locating the embedment points 5 and 6 of the external ends of the blades 1*a*, 1*b* outside the plane of the hairspring, especially on one side of the balance wheel 7 in the embodiment shown in FIG. 9. Thus, these two embedment points may be respectively located on either side of the plane of the hairspring, so that the two blades 1*a*, 1*b* form two symmetrical cones on either side of the plane of the hairspring. This solution has the advantage of preventing the turns of the two blades from touching each other and makes it possible to produce hairsprings of small diameter with a large number of turns. Such a solution therefore constitutes another means of preventing contact between the blades of the hairspring during the alternation of expansions and contractions.

Figure 10A:
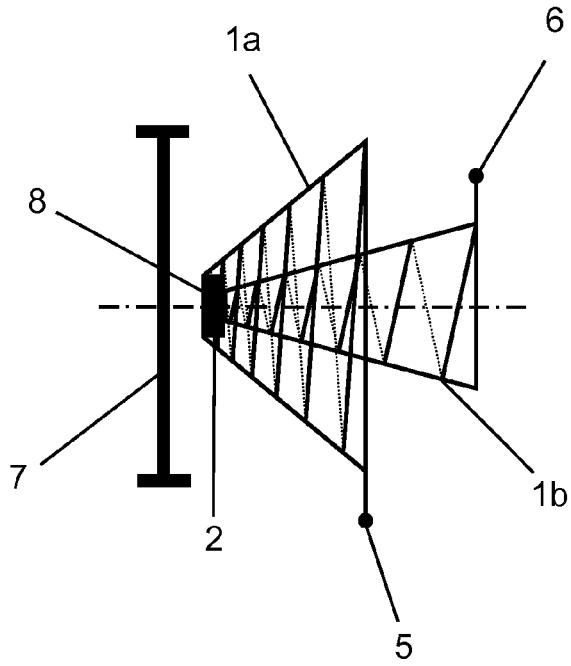
FIGS. 10*a* and 10*b* are side views of two variants of an eighth embodiment.
Figure 10B:
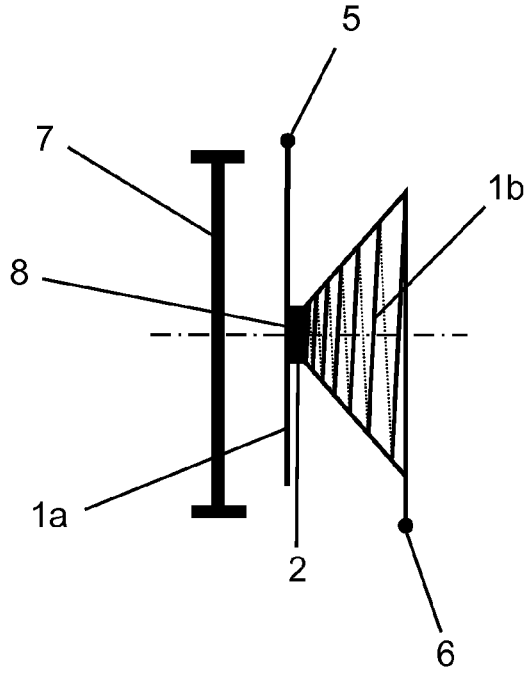

According to another variant of the invention, the two blades 1*a*, 1*b* are made on an SOI (Silicon-On-Insulator) wafer as shown in FIGS. 10*a*, 10*b*, which consists of an Si—$SiO_2$—Si multilayer stack. A blade 1*a* is etched from the external face of one of the Si layers and the other blade 1*b* is etched from the external face of the second Si layer. In this case, the internal ends of the two blades are fastened via the intermediate $SiO_2$ layer 8. The advantage of this embodiment is that it reduces the diameter of the hairspring, as the distance between two adjacent turns is increased. Such an advantage is even more pronounced if the hairspring is extended vertically, as shown in FIG. 10.

Figure 11:
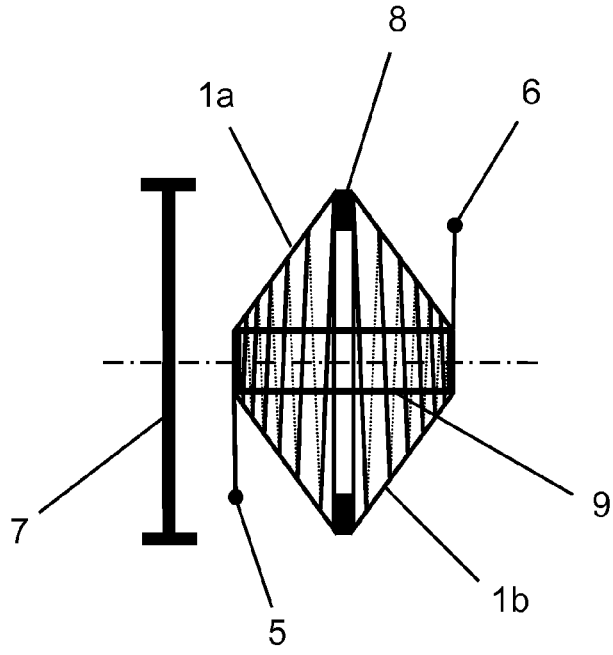
FIG. 11 is a side view of a ninth embodiment.

FIG. 11 illustrates another variant of FIGS. 10*a*, 10*b* in which the internal ends of the blades 1*a*, 1*b* are fastened to the same collet 8, whereas their external ends are fastened to the $SiO_2$ intermediate layer 5.

The invention claimed is:

1. A balance wheel/hairspring resonator, which comprises a balance wheel having a central arbor and a hairspring having n blades, where $n \geqq 2$, wound around the central arbor, each blade having an inner end and an outer end, wherein the outer end is located farther from the central arbor than the inner end, wherein the inner ends of the blades are fastened to the central arbor in a homologous manner with an angular offset of the internal ends about the central arbor, wherein the blades are coplanar, and wherein the blades are wound in spirals with an angular offset, so as to neutralize the lateral forces likely to be exerted on the central arbor when one of the ends of each blade is moved angularly about said central arbor relative to its other end.

2. The balance wheel/hairspring resonator as claimed in claim 1, wherein the blades are fastened to each other via their at least two respective inner ends.

3. The balance wheel/hairspring resonator as claimed in claim 1, wherein a pitch of each of the blades varies along a length of the blade.

4. The balance wheel/hairspring resonator as claimed in claim 1, wherein a thickness of each of the blades varies along a length of the blade.

5. The balance wheel/hairspring resonator as claimed in claim 1, which is formed from single-crystal silicon.

6. The balance wheel/hairspring resonator as claimed in claim 5, wherein the single-crystal silicon is covered with a layer of amorphous silicon oxide.

7. The balance wheel/hairspring resonator as claimed in claim 1, which is formed from quartz.

8. The balance wheel/hairspring resonator as claimed in claim 1, wherein the outer ends of the blades are fastened to a common ring in an homologous manner with an angular offset of the external ends about the central arbor.

9. The balance wheel/hairspring resonator as claimed in claim 8, wherein the outer ends of the blades are angularly offset with respect to one another by an angle of $2\pi/n$.

10. The balance wheel/hairspring resonator as claimed in claim 1, wherein the inner ends of the blades are angularly offset with respect to one another by an angle of $2\pi/n$.

11. The balance wheel/hairspring resonator as claimed in claim 1, wherein the n blades are internal blades, and the hairspring further comprises m external blades, where m≧2, the external blades being located farther from the central arbor than the internal blades.

12. The balance wheel/hairspring resonator as claimed in claim 11, wherein the outer ends of the external blades are fastened to a common ring in an homologous manner with an angular offset of the external ends about the central arbor.

13. The balance wheel/hairspring resonator as claimed in claim 11, wherein the outer ends of the internal blades and the inner ends of the external blades are fastened to an intermediate ring.

14. The balance wheel/hairspring resonator as claimed in claim 11, wherein the internal blades and the external blades are wound in a same direction.

15. The balance wheel/hairspring resonator as claimed in claim 11, wherein the internal blades and the external blades are wound in opposite directions.

16. The balance wheel/hairspring resonator as claimed in claim 11, wherein there are two internal blades and two external blades.

* * * * *